US009522778B2

(12) United States Patent
Southwell et al.

(10) Patent No.: US 9,522,778 B2
(45) Date of Patent: Dec. 20, 2016

(54) BIN OUTLET INSERTS, AND BIN ASSEMBLY SYSTEMS AND METHOD EMPLOYING SUCH INSERTS

(71) Applicant: BAYER CROPSCIENCE LP, Research Triangle Park, NC (US)

(72) Inventors: Robert Peter Southwell, Nobleford (CA); Edwin Ralph Williamson, Fort MacLeod (CA)

(73) Assignee: BAYER CROPSCIENCE LP, Research Triangle Park, NC (US)

( * ) Notice: Subject to any disclaimer, the term of this patent is extended or adjusted under 35 U.S.C. 154(b) by 0 days.

(21) Appl. No.: 14/547,512

(22) Filed: Nov. 19, 2014

(65) Prior Publication Data

US 2015/0175348 A1 Jun. 25, 2015

Related U.S. Application Data

(60) Provisional application No. 61/920,051, filed on Dec. 23, 2013.

(51) Int. Cl.

| | |
|---|---|
| ***B67D 7/06*** | (2010.01) |
| ***B65D 88/28*** | (2006.01) |
| ***B65D 90/58*** | (2006.01) |

(52) U.S. Cl.

CPC ..... *B65D 88/28* (2013.01); *B65D 90/587* (2013.01)

(58) Field of Classification Search

CPC ..... B65D 88/28; B65D 90/587
USPC ..... 222/181.1, 181.2, 181.3, 561, 564, 547,222/575, 566, 460, 129; 221/312, 312 R, 304; 220/565, 287, 302; 414/414; 141/9, 103

See application file for complete search history.

(56) References Cited

U.S. PATENT DOCUMENTS

| | | | | | |
|---|---|---|---|---|---|
| 1,630,605 | A | * | 5/1927 | Butler | B65D 88/26 222/129 |
| 1,668,825 | A | * | 5/1928 | Sobek | B65D 88/28 193/2 R |
| 1,724,403 | A | * | 8/1929 | Hutchinson | B28C 7/0007 222/129 |
| 1,820,297 | A | * | 8/1931 | Butler | G01G 13/00 222/129 |
| 2,317,175 | A | * | 4/1943 | Burdick | B65D 90/587 318/102 |

(Continued)

FOREIGN PATENT DOCUMENTS

| | | |
|---|---|---|
| DE | 1 269 955 B | 6/1968 |
| EP | 1 018 475 A1 | 7/2000 |

*Primary Examiner* — Kevin P Shaver
*Assistant Examiner* — Michael J Melaragno
(74) *Attorney, Agent, or Firm* — McBee Moore Woodard Vanik IP, LLC.

(57) ABSTRACT

Bin outlet inserts, and systems and methods employing bin outlet inserts for discharging materials are disclosed herein. For example, the bin outlet insert can be a transition device internal to and installed at a bottom of the bin that allows the circular outlet of a bin to be converted to a rectangular outlet (e.g., square outlet). A slide gate arranged at the bin outlet modulates the discharge of material (e.g., grain or seeds) from the bin. The rectangular cross-section of the outlet of the bin insert allows for a linear correspondence between displacement of the slide gate across the outlet to the volume flow of material discharged by the bin. Calculation of sliding gate position for a desired volume discharge, for example, in blending materials from multiple bins, can be simplified over using a circular outlet.

4 Claims, 8 Drawing Sheets

(56) References Cited

U.S. PATENT DOCUMENTS 2,460,605 A * 2/1949 Soissa ..... D21H 5/06 118/310
2,900,109 A * 8/1959 Hoopes ..... B28B 17/02 222/1
2,943,752 A 7/1960 Platt
2,982,445 A * 5/1961 Koble ..... B65G 47/00 222/132
3,157,312 A * 11/1964 Kitterman ..... B65D 75/5883 128/DIG. 24
3,178,068 A * 4/1965 Dumbaugh ..... B65D 88/66 198/658
3,245,584 A * 4/1966 Linville ..... B01F 15/0445 222/132
3,387,570 A * 6/1968 Pulcrano ..... B61D 7/20 105/282.3
3,690,392 A * 9/1972 Smith ..... G01G 13/242 141/196
3,741,440 A * 6/1973 Sanders, Jr. ..... B01F 5/247 222/132
3,822,056 A * 7/1974 Hawes, Jr. ..... B01F 15/0441 119/57.1
3,858,772 A * 1/1975 Myers, Jr. ..... B28B 13/0215 222/460
3,924,781 A * 12/1975 Witte ..... B65B 39/002 222/181.3
4,016,970 A 4/1977 Wert
4,151,932 A * 5/1979 Wachtler ..... G01G 13/026 222/144.5
4,282,988 A * 8/1981 Hulbert, Jr. ..... B65D 88/28 222/184
4,359,176 A * 11/1982 Johnson ..... B61D 7/28 105/240
4,360,044 A * 11/1982 Wisneski ..... B01F 5/244 141/100
4,548,342 A * 10/1985 Fisher ..... B65D 88/28 222/145.6
4,561,222 A * 12/1985 Fons ..... B65D 88/025 206/515
4,850,304 A * 7/1989 Nicholson ..... B01F 5/241 118/310
4,869,915 A * 9/1989 Inayoshi ..... A23G 3/28 426/533
4,938,250 A * 7/1990 Peterson ..... B65D 90/587 137/240
5,038,966 A * 8/1991 Olk ..... B65D 90/587 105/282.1
5,190,182 A * 3/1993 Copas ..... B65D 90/587 110/173 R
5,356,048 A * 10/1994 Geiser ..... B65D 90/10 220/327
5,402,915 A 4/1995 Hogan
5,449,146 A * 9/1995 Weagraff ..... B65D 90/587 251/326
5,533,650 A * 7/1996 Conrad ..... B65D 88/66 222/161
5,538,050 A * 7/1996 Galdon ..... B65B 67/12 141/10
5,603,359 A * 2/1997 Geiser ..... B65G 69/0458 141/1
6,000,445 A * 12/1999 Schuh ..... G01G 13/024 141/104
6,059,372 A * 5/2000 McDonald ..... B60P 1/56 298/27
6,102,562 A 8/2000 Bengtson
6,153,238 A * 11/2000 Shannon ..... A21C 15/005 220/789
6,250,514 B1 6/2001 Hansson
6,340,279 B1 * 1/2002 Wipf ..... B65D 88/28 198/540
6,447,674 B1 * 9/2002 Simon ..... G01G 13/024 177/105
6,450,754 B1 9/2002 Catton
6,508,387 B1 * 1/2003 Simon ..... B65D 90/587 137/554
6,609,638 B1 8/2003 Lott
6,786,362 B2 * 9/2004 Sisk ..... B65D 90/623 222/181.1
6,871,457 B2 3/2005 Quintero-Flores et al.
6,971,495 B2 12/2005 Hedrick et al.
6,981,614 B2 * 1/2006 Niggemyer ..... B65D 75/5883 222/107
7,568,496 B2 * 8/2009 Kraenzle ..... F16L 41/16 137/454.2
7,820,237 B2 * 10/2010 Harrington, Jr. ..... B32B 11/02 427/186
8,746,959 B2 * 6/2014 Bachman ..... A01K 5/001 366/132
2003/0071090 A1 * 4/2003 Johanson ..... B65D 88/28 222/547
2003/0131891 A1 * 7/2003 Sinur ..... F16K 15/03 137/527.8
2003/0222411 A1 * 12/2003 Simon ..... E02B 7/28 277/630
2004/0052590 A1 * 3/2004 Hedrick ..... B65D 88/28 406/122
2005/0263014 A1 * 12/2005 Ejeblad ..... A23G 3/28 99/494
2007/0028466 A1 * 2/2007 Slye ..... G01B 21/02 33/1 PT
2007/0170207 A1 * 7/2007 Kraus ..... B65G 65/44 222/199
2007/0255450 A1 * 11/2007 Mazur ..... G07F 11/44 700/236
2008/0029546 A1 * 2/2008 Schuld ..... B65D 88/26 222/185.1
2008/0277423 A1 * 11/2008 Garton ..... B29C 41/06 222/185.1
2008/0302796 A1 * 12/2008 Irnich ..... C21B 7/20 220/263
2009/0008410 A1 * 1/2009 Kosich ..... B65D 88/1668 222/105
2010/0147880 A1 * 6/2010 Kreutzer ..... C04B 14/30 222/55
2011/0011893 A1 * 1/2011 Cerny ..... B65D 88/30 222/185.1
2011/0214780 A1 * 9/2011 Pahl ..... G01G 19/22 141/99
2012/0067927 A1 * 3/2012 Raz ..... B65D 90/587 222/561
2012/0205319 A1 * 8/2012 Christy ..... C02F 1/02 210/737
2012/0209420 A1 * 8/2012 Christy ..... B65G 65/4809 700/218
2012/0234865 A1 * 9/2012 Renyer ..... A01C 1/06 222/185.1
2013/0269296 A1 * 10/2013 Wootton ..... B65D 47/121 53/467
2015/0190769 A1 * 7/2015 Freeman ..... B01F 15/0445 426/231

* cited by examiner

BIN OUTLET INSERTS, AND BIN ASSEMBLY SYSTEMS AND METHOD EMPLOYING SUCH INSERTS

CROSS-REFERENCE TO RELATED APPLICATIONS

The present application claims the benefit of U.S. Provisional Application No. 61/920,051, filed Dec. 23, 2013, which is hereby incorporated by reference herein in its entirety.

FIELD

The present disclosure relates generally to storage of materials, such as grain or seeds, and, more particularly, to an insert for an outlet of a bin, and systems and methods for discharging materials from the bin with the insert.

SUMMARY

Bin outlet inserts, and systems and methods employing bin outlet inserts for discharging materials are disclosed herein. For example, the bin outlet insert can be a transition device internal to and installed at a bottom of the bin that allows the circular outlet of a bin to be converted to a rectangular outlet (e.g., square outlet). A slide gate arranged at the bin outlet modulates the discharge of material (e.g., grain or seeds) from the bin. The rectangular cross-section of the outlet of the bin insert allows for a linear correspondence between displacement of the slide gate across the outlet to the volume flow of material discharged by the bin. Calculation of sliding gate position for a desired volume discharge, for example, in blending materials from multiple bins, can be simplified over using a circular outlet.

In one or more embodiments, a bin outlet insert can be provided for a bin assembly that has a circular outlet. The bin outlet insert can include a substantially circular top opening, a substantially rectangular bottom opening, and a truncated conical outer sidewall. The truncated conical outer sidewall can extend from the circular top opening and can be constructed to contact a conical interior wall of the bin assembly so as to support the insert in the inner volume of the bin assembly. The bottom opening can be in the circular outlet in plan view.

In one or more embodiments, a bin outlet insert can be provided for a bin assembly that has a circular outlet. The bin outlet insert can include a truncated conical top portion and a bottom portion. The truncated conical top portion can have a tapered internal surface extending from a circular top opening. The bottom portion can have a rectangular internal surface extending from a rectangular bottom opening. The bottom opening can be within a perimeter of the top opening in plan view.

In one or more embodiments, a bin outlet insert can be provided for a bin assembly having a circular outlet. The bin outlet insert can have a central axis and can include an upper first portion and a lower second portion. The upper first portion can have a first surface extending from a top perimeter toward the central axis. The lower second portion can have a rectangular outlet distal from the upper first portion and a rectangular conduit extending along the central axis to the rectangular outlet.

In one or more embodiments, a bin assembly can include a cylindrical bin, a tapered hopper bottom, a slide gate, and a bin outlet insert. The tapered hopper bottom can be arranged at a first end of the cylindrical bottom and can have a circular outlet. The slide gate can be coupled to the circular outlet and can be constructed to modulate material exiting the hopper bottom outlet by displacing to expose portions of the outlet. The bin outlet insert can be disposed within the tapered hopper bottom adjacent to the circular outlet. The bin outlet insert can have a rectangular opening disposed within the circular outlet. The bin outlet insert can be constructed to convey material in the cylindrical bin through the rectangular opening, thereby converting the circular outlet of the hopper bottom to a rectangular opening.

In one or more embodiments, a system for proportioning material contained in bin assemblies can include a plurality of the above-described bin assemblies. The system can also include one or more conveyances constructed to receive material discharged from the plurality of the bin assemblies.

In one or more embodiments, a method for proportioning material contained in a plurality of bin assemblies having circular outlets can include inserting into an interior volume of a tapered hopper bottom of each bin a bin outlet insert with a rectangular opening, such that the hopper bottom outlet is converted from a circular to rectangular outlet. The method can further include displacing a slide gate of each bin assembly with respect to the respective hopper bottom outlet to allow material contained therein to be discharged. The slide gate displacement can have a linear correspondence to the amount of material discharged through the respective hopper bottom outlet. The method can also include combining the discharged materials together.

Objects and advantages of embodiments of the disclosed subject matter will become apparent from the following description when considered in conjunction with the accompanying drawings.

BRIEF DESCRIPTION OF DRAWINGS

Embodiments will hereinafter be described with reference to the accompanying drawings, which have not necessarily been drawn to scale. Where applicable, some features may not be illustrated to assist in the illustration and description of underlying features. Throughout the figures, like reference numerals denote like elements.

DETAILED DESCRIPTION

Figure 1:
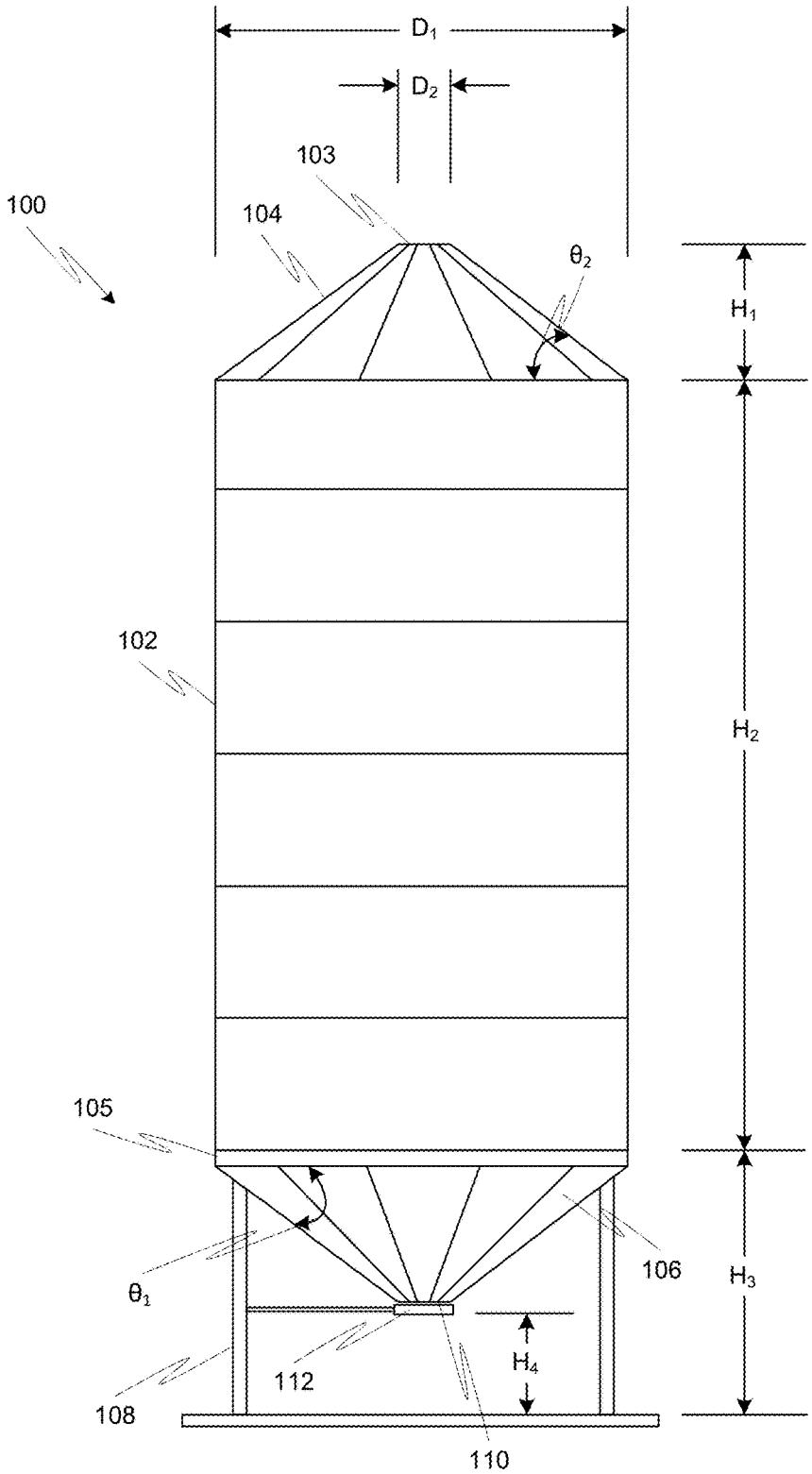
FIG. 1 is an elevation view of a bin assembly, according to one or more embodiments of the disclosed subject matter.

A bin assembly 100 can be used to store a material, such as grain, seeds, or other dry material, for later disbursement. For example, the bin assembly 100 can include a substantially cylindrical sidewall 102, as shown in FIG. 1. At a bottom of the cylindrical sidewall, an eave 105 can connect the sidewall 102 to a tapered hopper bottom 106, which may be in the form of a truncated cone or truncated polygonal pyramid, such as an octagonal-base pyramid, with a substantially circular outlet 110 at a lowermost portion of the hopper bottom 106. Thus, a sidewall forming the hopper bottom 106 extends at an angle (e.g., 40° angle) from the eave 105 toward a central axis of the bin so as to channel material from the cylindrical sidewall 102 central portion to outlet 110.

Supports 108 can attach to the hopper bottom 106, the eave 105, or any other portion of the bin to support the assembly 100 above the ground such that material contained within the bin can be discharged from outlet 110. Material can be loaded into the bin through, for example a hatch 103 in roof 104, which may also be in the form of a truncated cone or truncated polygonal pyramid. Thus, a sidewall forming the roof 104 extends at an angle (e.g., 35° angle) from a top of the cylindrical sidewall 102 toward a central axis of the bin.

To regulate the material discharged from the bin via outlet 110, a slide gate assembly 112 is disposed adjacent to the outlet 110. The position of the slide gate with respect to the outlet 110 adjusts the cross-section of the outlet 110 that is available for material to pass through. Thus, an operator can regulate the amount of material flowing out of the bin by appropriate positioning of the slide gate with respect to the outlet 110.

When mixing materials from different bins, it may be advantageous to have control of the proportion of materials dispensed from the bins. For example, a seed mixture may comprise specific ratios of individual seed types, which seed types are contained in different bins. By adjusting the position of the slide gate, the flow rate of the seed mixture through the outlet of the respective bin can be controlled and can correspond to the desired final ratio in the seed mixture. Other applications beyond mixing of different seeds are also possible according to one or more contemplated embodiments, such as, but not limited to, mixing of different grains or feeds.

Figure 2A:
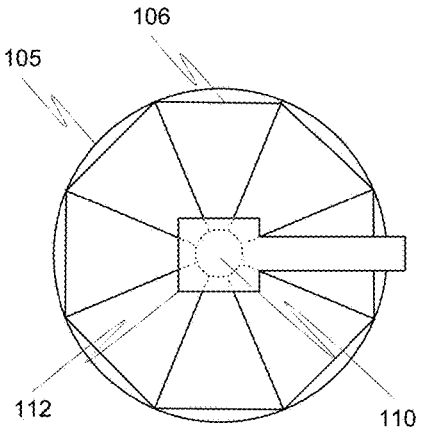
FIGS. 2A-2D are plan views of a bin hopper bottom with the slide gate at a closed, 25% open, 75% open, and 100% open positions, respectively, when the outlet is circular, according to one or more embodiments of the disclosed subject matter.
Figure 2B:
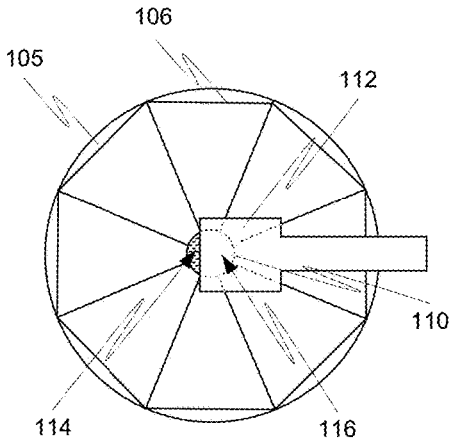
Figure 2C:
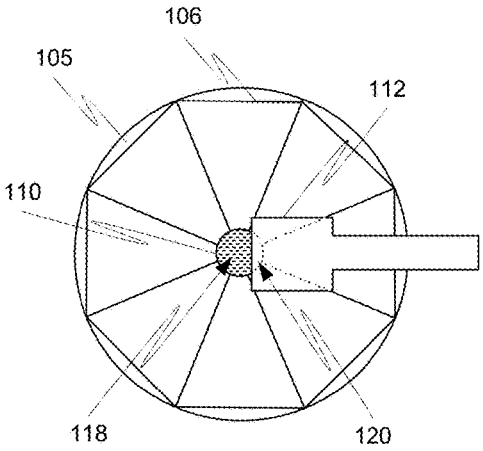
Figure 2D:
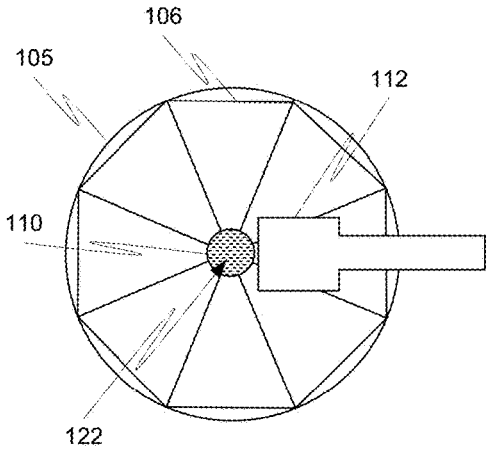

However, when using a slide gate with a circular outlet, such as outlet 110, the linear displacement of the slide gate with respect to the outlet does not necessarily result in a proportional change in the area of the outlet exposed. Referring to FIGS. 2A-2D, the change in open area of the outlet 110 as the slide gate 112 moves from a closed configuration (FIG. 2A) to an open configuration (FIG. 2D) is shown. The slide gate is at a 25% displacement configuration in FIG. 2B, with area 114 being open to allow passage of material through the outlet and the remainder 116 being obstructed by the slide gate 112. In FIG. 2C, the slide gate is at a 75% displacement configuration, with area 118 being open to allow passage of material and the remainder 120 being obstructed by the slide gate 112. In FIG. 2D, the slide gate is completely removed from the outlet 110, thereby allowing the entire area 122 of the outlet to be utilized for material discharge.

As the slide gate 112 moves across the outlet 110, the height of the outlet in a direction perpendicular to the displacement of the sliding gate 112 varies in a non-linear manner, reaching a peak at the 50% open configuration when the end of the slide gate reaches the center of the outlet 110 and decreasing as the sliding gate progresses further. Thus, the displacement of the sliding gate does not linearly correspond to the open area of the outlet, i.e., 25% displacement does not yield a 25% open area. Since the volume flow rate through the outlet is dependent upon the open area of the outlet, an operator would need to calculate the open area required for the desired mixing ratio as well as the appropriate location for the slide gate to achieve the calculated open area. Because of the circular cross-section of the outlet and the non-linear variation of exposed area based on slide gate position, the ability to determine the correct placement of the slide gate to achieve a desired volume flow rate of the material may be difficult to calculate.

In embodiments of the disclosed subject matter, a bin outlet insert can be provided that converts the bin outlet from a circular opening to a rectangular opening, thereby reducing the difficulty associated with determining appropriate slide gate placement. For example, the bin outlet insert can be a transition device internal to and installed at a bottom of the bin that allows the circular outlet of a bin to be converted to a rectangular outlet (e.g., square outlet). A slide gate arranged at the bin outlet modulates the discharge of material (e.g., grain or seeds) from the bin. The rectangular cross-section of the outlet of the bin insert allows for a linear correspondence between displacement of the slide gate across the outlet to the volume flow of material discharged by the bin. Calculation of sliding gate position for a desired volume discharge, for example, in blending materials from multiple bins, can be simplified as compared to a circular outlet.

Referring to FIGS. 3A-3D, various illustrations of an exemplary bin outlet insert 300 are shown. The bin outlet insert 300 can serve as an internal bottom transition, installed within a hopper bottom adjacent to the outlet, to convert the circular outlet to a rectangular cross-section (see, for example, FIGS. 6A-6C). The bin outlet insert can be made from a material with sufficient strength to support the material within the bin during discharge and to withstand wear and tear from use over time (e.g., on the order of years).

For example, the bin outlet insert can be formed of a metal material, such as aluminum or steel, although other materials are also possible according to one or more contemplated embodiments.

The bin outlet insert 300 can have a substantially circular top opening 303, for example, defined by perimeter 302 (e.g., upper edge or upper surface defined by a thickness of the material forming sidewall 306). At an opposite end of the bin outlet insert 300, a substantially rectangular bottom opening 305 can be provided, for example, defined by perimeter 304 (e.g., bottom edge or bottom surface defined by a thickness of the material forming a lower sidewall of the insert). For example, the bottom opening 305 can be a square or a rectangle elongated in a direction parallel to a displacement direction of the sliding gate 112.

Figure 3A:
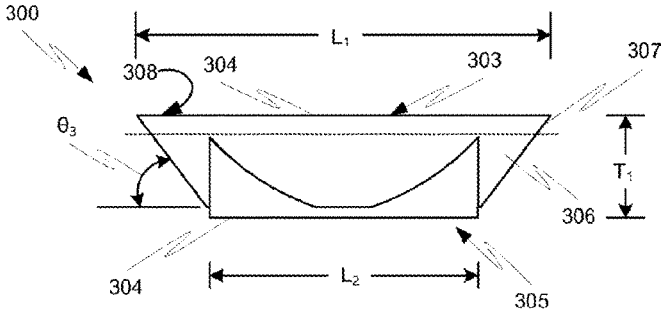
FIGS. 3A-3B show side and top-down views of a bin outlet insert, according to one or more embodiments of the disclosed subject matter.
Figure 3B:
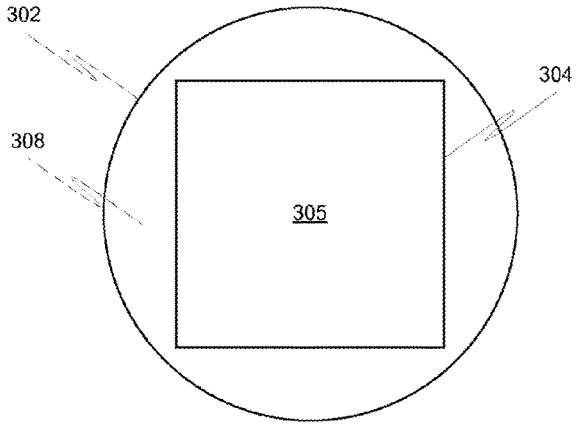
Figure 3C:
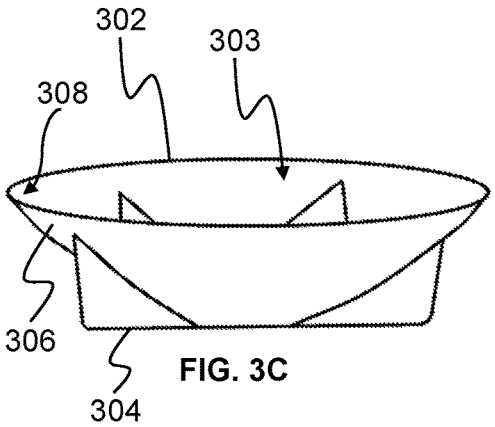
FIGS. 3C-3D show side and top photos of a bin outlet insert, according to one or more embodiments of the disclosed subject matter.
Figure 3D:
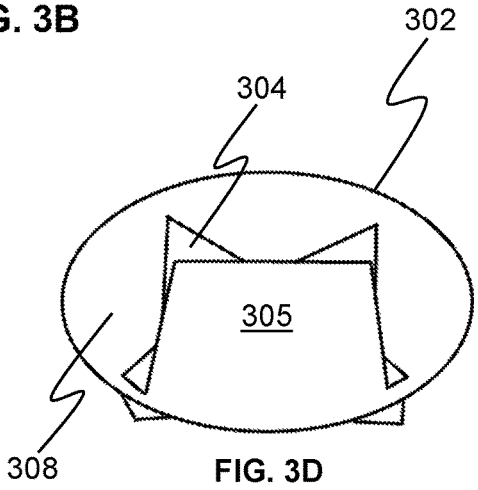

Connecting the top opening 303 to the bottom opening 305 is an internal surface 308, which can act as an internal transition surface and form a conduit through which material passes in order to exit the bin. The internal transition surface can be tapered and/or curved, for example, to allow for free flowing transition between the circular top opening 303 and the rectangular bottom opening 305. Alternatively or additionally, a conical internal surface at an upper portion of the insert 300 can join with a lower internal surface forming a substantially rectangular conduit in plan view to form the transition surface 308. Thus, the upper portion can join with the lower portion along a concave arc with an apex thereof proximal to the bottom opening 305, as shown in FIGS. 3C-3D.

A tapered outer sidewall 306, for example, a truncated conical sidewall, can extend from the circular top opening 303. The sidewall 306 can extend at an angle so as to taper toward a central axis of the bin. The angle of the sidewall 306 can be the same or different from that of the bin. For example, the angle of the sidewall 306 can be such that only an upper portion 307 of the sidewall 306 abuts the hopper bottom sidewall and supports the insert 300 within the bin when installed in the bin assembly. Alternatively, the insert 300 can be supported within the bin by contact with the hopper bottom sidewall along the entire sidewall 306.

Figure 4A:
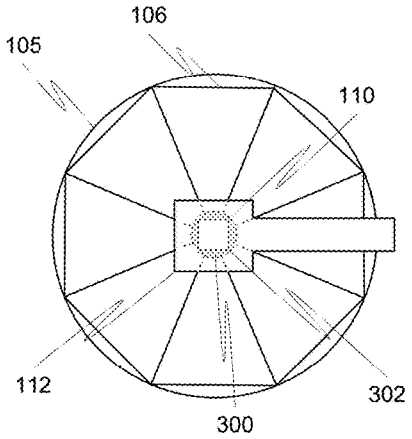
FIGS. 4A-4D are plan views of a bin hopper bottom with the slide gate at a closed, 25% open, 75% open, and 100% open positions, respectively, with the bin outlet insert installed, according to one or more embodiments of the disclosed subject matter.
Figure 4B:
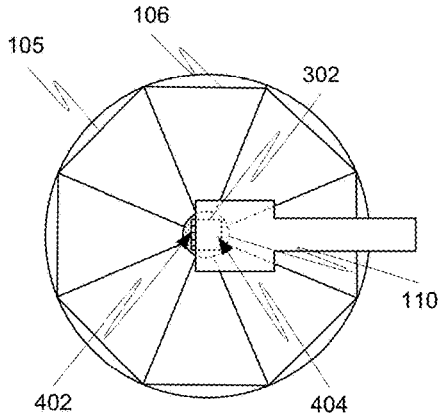
Figure 4C:
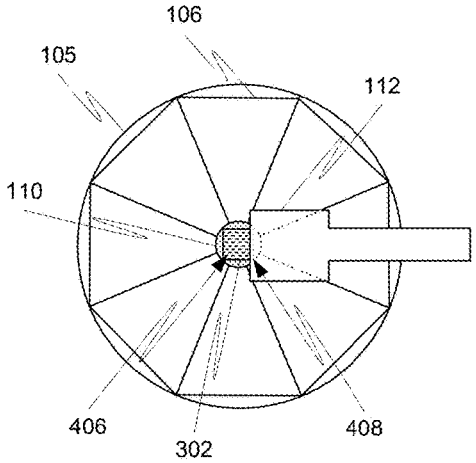
Figure 4D:
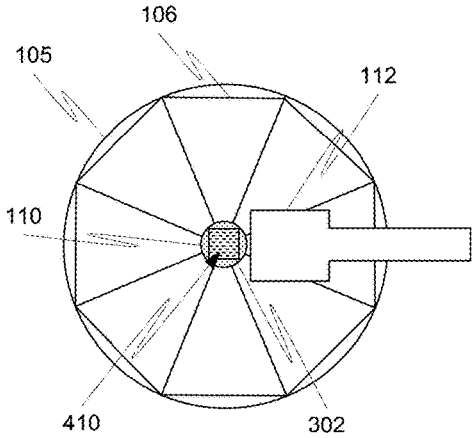

When using a slide gate 112 with insert 300 installed in outlet 110, the displacement of the slide gate with respect to the outlet results in a linear change in the area of the outlet exposed. Referring to FIGS. 4A-4D, the change in open area of the outlet 110 as the slide gate 112 moves from a closed configuration (FIG. 4A) to an open configuration (FIG. 4D) is shown. The slide gate is at a 25% displacement configuration in FIG. 4B, with area 402 being open to allow passage of material through the outlet and the remainder 406 being obstructed by the slide gate 112. In FIG. 4C, the slide gate is at a 75% displacement configuration, with area 406 being open to allow passage of material and the remainder 408 being obstructed by the slide gate 112. In FIG. 4D, the slide gate is completely removed from the outlet 110, thereby allowing the entire area 410 of the outlet to be utilized for material discharge.

TABLE 1

Exemplary dimensions of bin assembly and insert

| Label | Description | Dimensions |
|---|---|---|
| $D_1$ | Diameter of bin | 16 feet |
| $D_2$ | Diameter of roof hatch | 25 inches |
| $H_1$ | Height of roof | 62.625 inches |
| $H_2$ | Height of bin cylinder | 30 feet |
| $H_3$ | Height of eave above ground | 128.125 inches |

TABLE 1-continued

Exemplary dimensions of bin assembly and insert

| Label | Description | Dimensions |
|---|---|---|
| $H_4$ | Height of gate above ground | 48.3125 inches |
| $\theta_1$ | Angle of roof | 35° |
| $\theta_2$ | Angle of hopper bottom | 40° |
| $L_1$ | Diameter of top opening of insert | 18 inches |
| $L_2$ | Edge length of bottom opening of insert | 11.875 inches |
| $T_1$ | Height of insert | 4.5 inches |
| $\theta_3$ | Angle of insert sidewall | 35° |

Figure 6A:
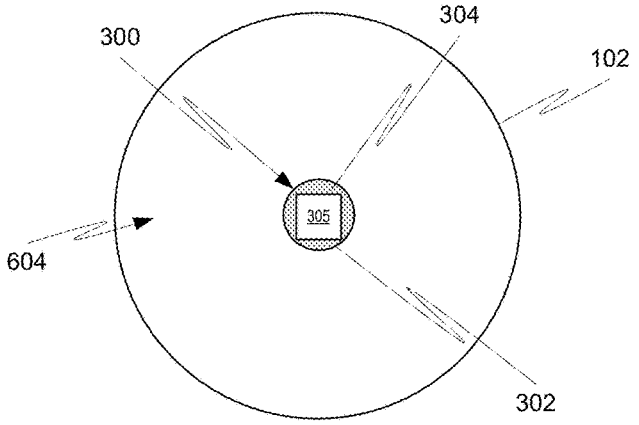
FIGS. 6A-6C illustrate an internal top-down plan view, a partial elevation view, and a bottom-up plan view of a bin assembly with the bin outlet insert installed, according to one or more embodiments of the disclosed subject matter.
Figure 6B:
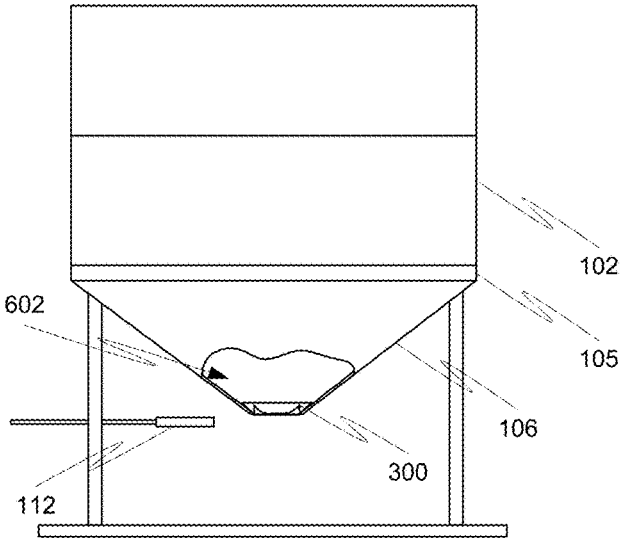
Figure 6C:
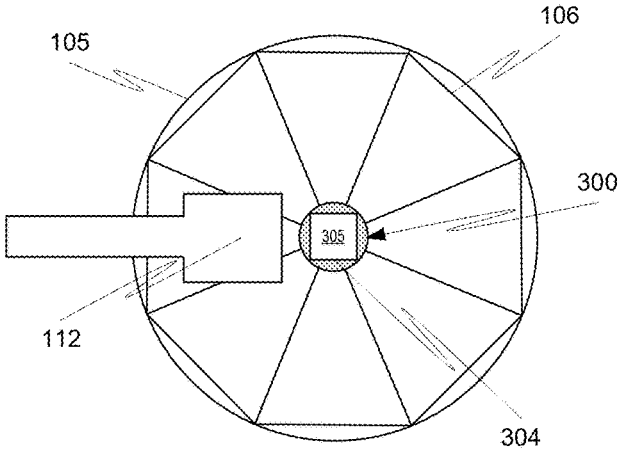

As the slide gate 112 moves across the outlet 110, the height of the outlet in a direction perpendicular to the displacement of the sliding gate 112 remains constant. Thus, the displacement of the sliding gate linearly corresponds to the open area of the outlet, and an operator can more easily calculate the correct placement of the slide gate for a desired volume flow rate or amount of material to be dispensed. Material within the bin can thus exit the bin via rectangular opening 305 of the bin outlet insert 300 installed in the hopper bottom 106 of the bin, as shown in FIGS. 6A-6C, where 602 refers to a cutaway portion of hopper bottom 106 illustrating an interior volume of the bin.

Figure 5A:
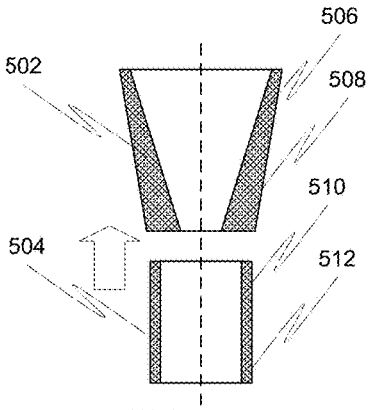
FIGS. 5A-5B illustrate cross-sectional views of component aspects for a bin outlet insert, according to one or more embodiments of the disclosed subject matter.

Other configurations for a bin insert that is supported internal to the bin and converts a circular outlet thereof to a rectangular outlet are also possible according to one or more contemplated embodiments. For example, a bin outlet insert 500 can be a combination of an upper truncated conical portion 502 and a lower rectangular portion 504, as shown in FIG. 5A. The upper conical portion 502 can have an external wall 508 that is angled toward a central axis and an inner wall 506 that defines an opening at a top of the upper portion and a tapered conduit extending therethrough. The lower rectangular portion 504 can include an outer cylindrical wall 512 and an inner wall 510 that defines an opening at a bottom of the lower portion and a constant cross-section conduit extending therethrough.

Figure 5B:
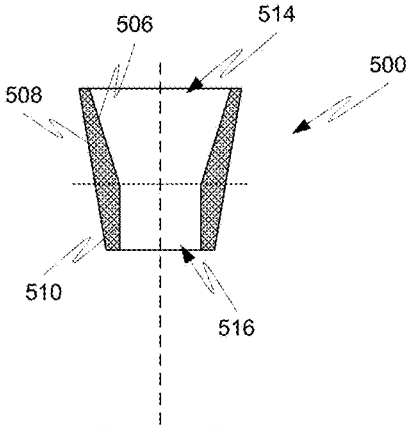

By merging the upper portion 502 and the lower portion 504, an insert 500 can be formed, as shown in FIG. 5B. The portions can be merged such that an internal and/or external transition between the portions are smooth or allow for a free flow of material. For example, the insert 500 can adopt the angled sidewall 508 of the upper portion such that the outer perimeter forms a circle at both the top and bottom ends. However, the internal surfaces may be merged such that a circular opening 514 is formed by wall 506 for the upper portion of the insert 500 while a rectangular outlet 516 is formed by wall 510. Thus, the bottom portion would have an outer bottom edge forming a circle in plan view while an internal edge defining the rectangular bottom opening 516 is disposed internally from the outer bottom edge in the plan view.

Figure 7:
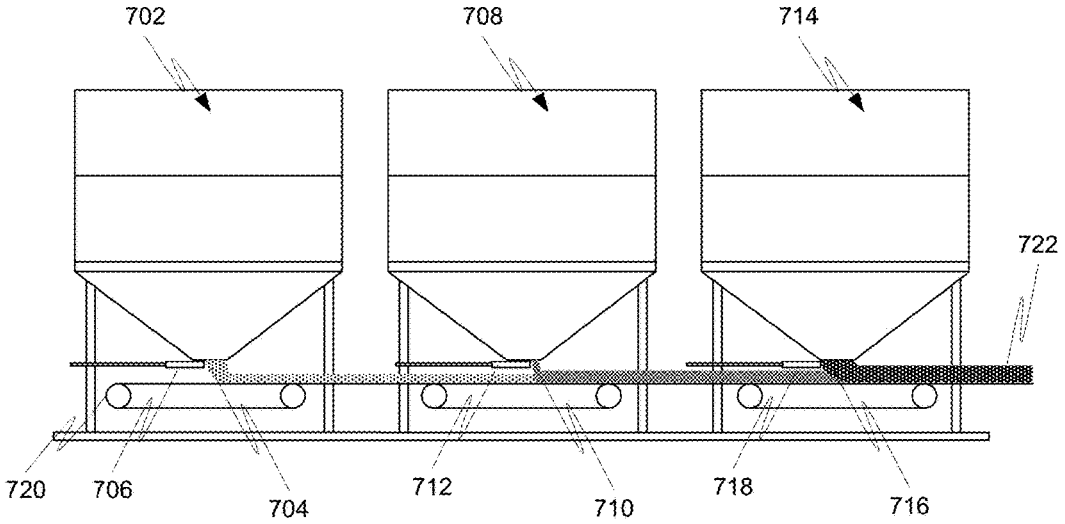
FIG. 7 is an elevation view of multiple bin assemblies and a conveyance mechanism for mixing of various materials, according to one or more embodiments of the disclosed subject matter.

As noted above, when mixing materials from different bins, it may be advantageous to have control of the proportion of materials dispensed from the bins. Thus, a system for mixing materials can include a first bin 702 for dispensing a first material 704, a second bin 708 for dispensing a second material 710, and a third bin 714 for dispensing a third material 716, as shown in FIG. 7. Although three bins are shown in FIG. 7, fewer or additional bins are also possible according to one or more contemplated embodiments.

One or more conveyances can be constructed to receive material discharged from the plurality of the bin assemblies. For example, the one or more conveyances can be a common conveyor belt 720 disposed beneath each hopper bottom outlet for receiving a flow of material (e.g., 704, 710, and 716 therefrom) and conveying the final combination of materials (e.g., 722) for use or storage. Alternatively, each bin can have its own conveyor belt that empties into a common receptacle for use or storage. For example, the materials dispensed from the bins 702, 708, and 714 can be different types of seeds (for example, in preparing a desired combination of seeds in a seed mix), different types of grains, different types of feed, or any other type of material (e.g., dry material).

As discussed above, sliding gates (e.g., 706, 712, and 718 in FIG. 7) control the respective amounts of material discharged from the outlets of the bins based on the exposed area of the outlets. To simplify the computation of the sliding gate displacement that corresponds to the desired exposed area (and thus the desired volume flow rate), a bin outlet insert can be installed in the hopper bottom to convert the outlet opening from a circular opening to a substantially rectangular opening. In particular, the slide gate displacement can have a linear correspondence to the amount of material discharged through the respective hopper bottom outlet.

For example, the bin outlet insert installed in each bin can have the same rectangular outlet dimensions. Thus, the sliding gate displacement with respect to each rectangular bin outlet can be directly correlated to relative amounts of the discharged material. For example, in FIG. 7, sliding gate 706 may be displaced halfway with respect to the outlet area (thereby exposing 50% of the rectangular outlet area), sliding gate 712 may displaced one-quarter with respect to the outlet area (thereby exposing 25% of the rectangular outlet area), and sliding gate 718 displaced fully with respect to the outlet area (thereby exposing 100% of the rectangular outlet area), such that the ratio of dispensed material 704 to dispensed material 710 to dispensed material 716 is 2:1:4. Thus, the sliding gate displacement (which determines the exposed area of the outlet) can directly yield the desired mixing ratios of materials.

For example, a seed mixture may comprise specific ratios of individual seed types, which seed types are contained in different bins. By adjusting the position of the slide gate, the volume flow rate of the seed mixture through the outlet of the respective bin can be controlled and can correspond to the desired final ratio in the seed mixture. Other applications beyond mixing of different seeds are also possible according to one or more contemplated embodiments, such as, but not limited to, mixing of different grains or feeds.

Other configurations for the bin outlet insert are also possible according to one or more contemplated embodiments. For example, instead of a conical inner surface, the upper portion of the bin insert can have a piece-wise curved surface, as shown by the bin insert 800 of FIGS. 8A-8B. Similar to the embodiment of FIGS. 3A-3D, the bin outlet insert 800 can serve as an internal bottom transition, installed within a hopper bottom adjacent to the outlet, to convert the circular outlet to a rectangular cross-section (see, for example, FIGS. 6A-6C). The bin outlet insert can be made from a material with sufficient strength to support the material within the bin during discharge and to withstand wear and tear from use over time (e.g., years). For example, the bin outlet insert can be formed of a metal material, such as aluminum or steel, although other materials are also possible according to one or more contemplated embodiments.

The bin outlet insert 800 can have a substantially circular top opening 803, for example, defined by perimeter 802 (e.g., upper edge or upper surface defined by a thickness of the material forming sidewall 806). At an opposite end of the bin outlet insert 800, a substantially rectangular bottom opening 805 can be provided, for example, defined by perimeter 804 (e.g., bottom edge or bottom surface defined by a thickness of the material forming a lower sidewall of the insert). For example, the bottom opening 805 can be a square or a rectangle elongated in a direction parallel to a displacement direction of the sliding gate 112.

Figure 8A:
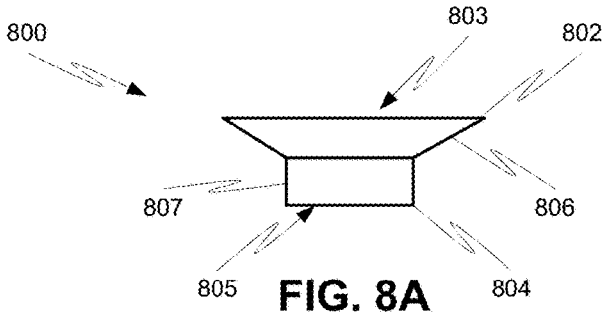
FIGS. 8A-8B are side and top-down plan views, respectively, of another bin outlet insert, according to one or more embodiments of the disclosed subject matter.
Figure 8B:
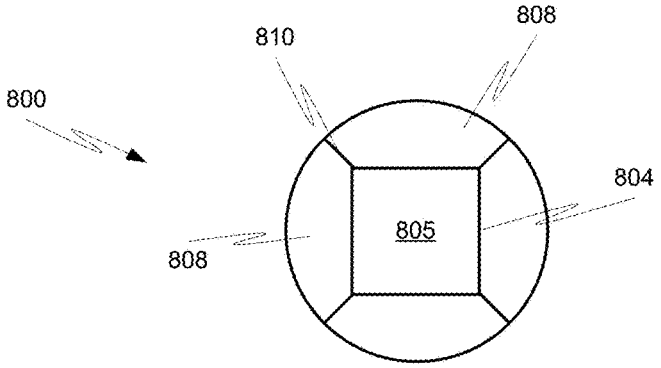

Connecting the top opening 803 to the bottom opening 805 is an upper internal surface and a substantially rectangular conduit 807. The upper internal surface can act as an internal transition surface and forms a conduit through which material passes to the rectangular conduit 807 in order to exit the bin. The upper internal surface can be formed by a plurality of petal-shaped quarter panels 808, each abutting an adjacent quarter panel 808 along a line 810 extending between the rectangular conduit 807 and the upper edge 802. Each petal-shaped quarter panel can include an outer edge that forms a portion of upper edge 802, the outer edge being substantially curved, and an inner edge that forms a portion of the entrance to conduit 807, the inner edge being substantially linear. Although only four quarter-panels are shown in FIGS. 8A-8B, additional or fewer panels are also possible according to one or more contemplated embodiments. Moreover, shapes other than a petal-shape are also possible according to one or more contemplated embodiments.

Figure 9A:
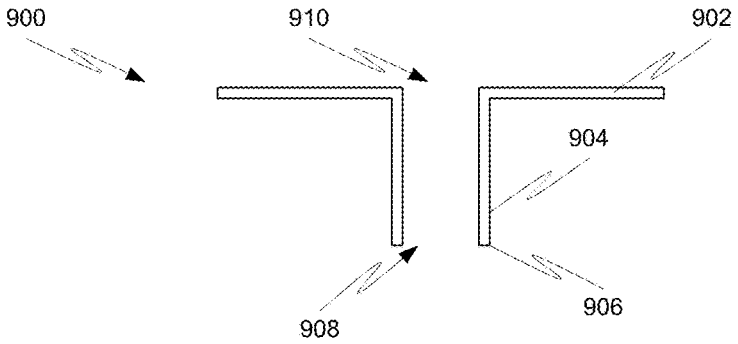
FIG. 9A is a cross-sectional view of another bin outlet insert, according to one or more embodiments of the disclosed subject matter.
Figure 9B:
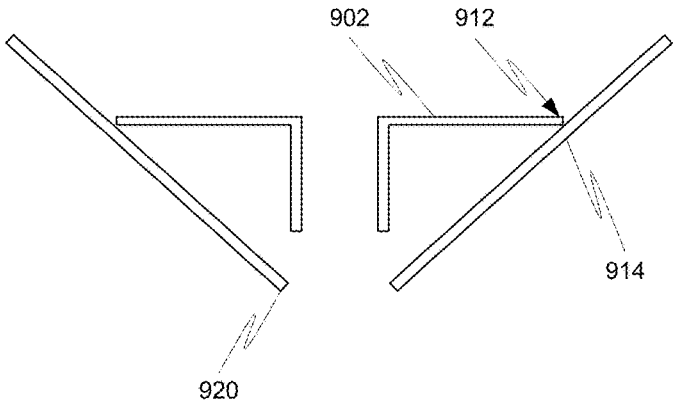
FIGS. 9B-9C show cross-sectional views of the bin outlet insert of FIG. 9A being installed in a tapered hopper bottom, according to one or more embodiments of the disclosed subject matter.
Figure 9C:
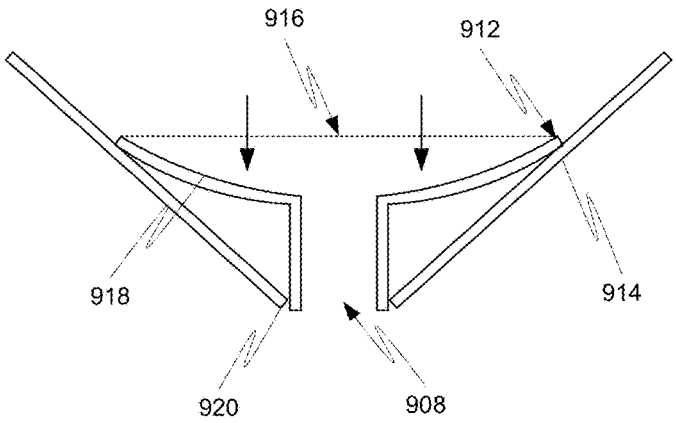

In another example, instead of a conical inner surface, the upper portion of the bin insert can be annular, as shown by bin insert 900 of FIGS. 9A-9C. Similar to the embodiment of FIGS. 3A-3D, the bin outlet insert 900 can serve as an internal bottom transition, installed within a hopper bottom adjacent to the outlet, to convert the circular outlet to a rectangular cross-section (see, for example, FIGS. 6A-6C). The bin outlet insert can be made from a material with sufficient strength to support the material within the bin during discharge and to withstand wear and tear from use over time (e.g., years). For example, the bin outlet insert can be formed of a metal material, such as aluminum or steel, although other materials are also possible according to one or more contemplated embodiments.

Prior to installation, the bin insert 900 does not have a circular top opening. Instead, annular plate 902 with a rectangular central opening 910 has a rectangular conduit 904 extending from the central opening 910. A bottom edge 906 of conduit 904 defines a substantially rectangular bottom opening 908. When the insert 900 is installed in the bin adjacent to circular opening 920, the tapered walls 914 of the hopper bottom interact with edge 912 of the annular plate 902 within the bin (FIG. 9B). As force is applied to the bin insert due to material loaded in the bin, annular plate 902 is caused to bend based on the interaction between edge 912 and wall 914 (FIG. 9C). The upper surface of the annular plate 902 is thus deformed to form a curved surface 918. In effect, the deformed bin insert 900 thus provides a circular top opening 916 with a free-flowing transition surface 918 that conveys material in the bin to a rectangular conduit 904 and thus outlet 908 adjacent to circular outlet 920 of the bin. The circular outlet 920 of the bin is thus converted to a rectangular outlet.

Figure 10A:
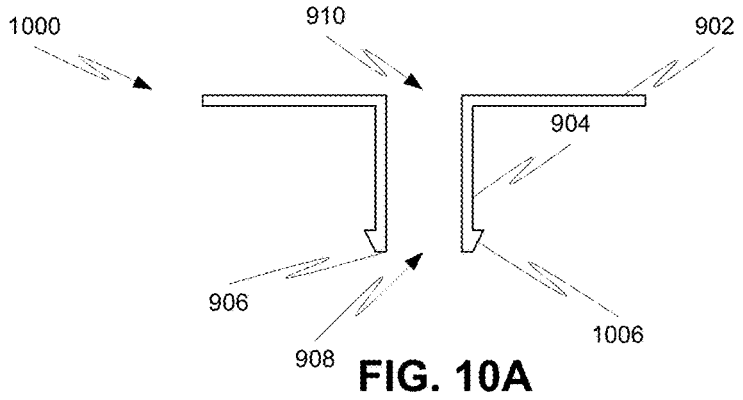
FIG. 10A is a cross-sectional view of another bin outlet insert, according to one or more embodiments of the disclosed subject matter.
Figure 10B:
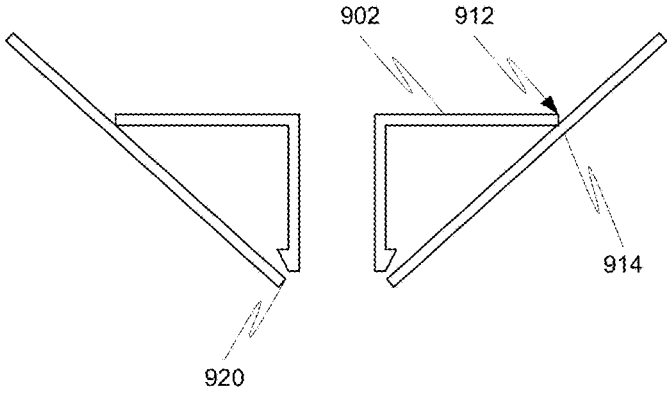
FIGS. 10B-10C show cross-sectional views of the bin outlet insert of FIG. 10A being installed in a tapered hopper bottom, according to one or more embodiments of the disclosed subject matter.
Figure 10C:
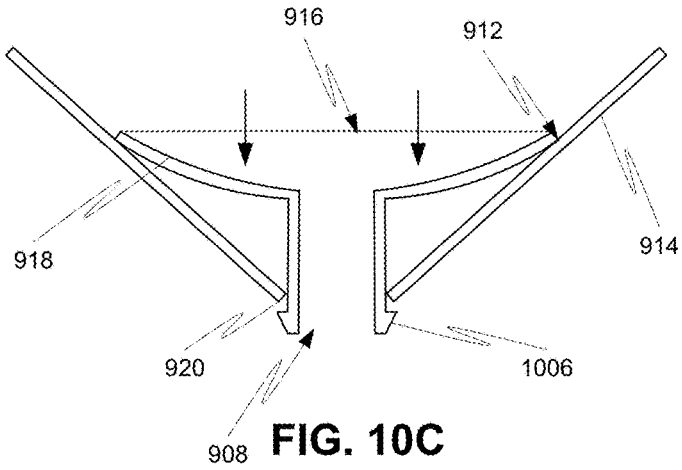

The bin outlet insert can also include features that retain the insert in a deformed state once installed and loaded in the bin. For example, a bin insert 1000 can include one or more tapered protrusions 1006 at bottom edge 906 of conduit 904, as shown in FIG. 10A. The tapered protrusions 1006 can extend along the entire length of one or each of the edges, or just a portion of one or each of the edges. For example, the tapered protrusion 1006 can be provided at each corner of the rectangle, a diagonal of the rectangular opening 908 being about equal to a diameter of the circular outlet 920. As the bin insert is installed (FIG. 10B) and loaded (FIG. 10C), the interaction between the edge of outlet 920 and the tapered surface of protrusions 1006 as the lower end of the insert 1000 pass through outlet 920 causes the conduit 904 to deflect inward. Once the protrusions pass through outlet 920, the conduit 904 returns to its normal shape, thereby bringing the flat rear portion of each protrusion 1006 into contact with outlet 920. The insert 1000 can thus be locked in place at the outlet of 920, with annular plate 902 in a deformed state as curved internal surface 918.

In first embodiments, a bin outlet insert can comprise a substantially circular top opening, a substantially rectangular bottom opening, and a truncated conical outer sidewall extending from the circular top opening and constructed to contact a conical interior wall of the bin assembly so as to support the insert in the inner volume of the bin assembly, with the bottom opening in the circular outlet of a bin assembly in plan view.

In first embodiments or any other embodiments, the conical outer surface can connect the top to a rectangular outer sidewall extending from the rectangular bottom opening.

In first embodiments or any other embodiments, the insert can comprise or be made of steel or aluminum.

In second embodiments, a bin outlet insert can comprise a truncated conical top portion having a tapered internal surface extending from a circular top opening, and a bottom portion having a rectangular internal surface extending from a rectangular bottom opening. The bottom opening can be within a perimeter of the top opening in plan view. The bin outlet insert can be for a bin assembly having a circular outlet.

In second embodiments or any other embodiments, the bin outlet insert can have top and bottom portions comprising or formed of metal.

In second embodiments or any other embodiments, the tapered internal surface can join the rectangular internal section along a concave arc with a bottom apex thereof proximal to the bottom opening.

In second embodiments or any other embodiments, the bottom portion can have an outer bottom edge forming a rectangle in the plan view.

In second embodiments or any other embodiments, the bottom portion can have an outer bottom edge forming a circle in the plan view. An edge defining the bottom opening can be disposed internally from the outer bottom edge in the plan view.

In second embodiments or any other embodiments, the tapered internal surface can form a free-flowing transition between the circular top opening and the rectangular bottom opening.

In third embodiments, a bin outlet insert can be for a bin assembly having a circular outlet. The bin outlet insert can have a central axis and can comprise an upper first portion having a first surface extending from a top perimeter toward the central axis, and a lower second portion having a rectangular outlet distal from the upper first portion and a rectangular conduit extending along the central axis to the rectangular outlet.

In third embodiments or any other embodiments, the first surface of the upper first portion can form an annular surface in plan view, the top perimeter being circular and an inner perimeter of the annular surface being a rectangle.

In third embodiments or any other embodiments, the upper first portion can be constructed to form a circular top opening and a free-flowing transition to the rectangular outlet by way of the first surface when inserted into the bin assembly.

In third embodiments or any other embodiments, the upper first portion can be configured to contact and support the bin outlet insert on a conical wall of a hopper bottom of the bin assembly.

In third embodiments or any other embodiments, the first and second portions can comprise a metal.

In fourth embodiments, a bin assembly can comprise a cylindrical bin, a tapered hopper bottom, a slide gate, and a bin outlet insert. The tapered hopper bottom can be arranged at a first end of the cylindrical bottom and can have a circular outlet. The slide gate can be coupled to the circular outlet and can be constructed to modulate material exiting the hopper bottom outlet by displacing to expose portions of the outlet. The bin outlet insert can be disposed within the tapered hopper bottom adjacent to the circular outlet. The bin outlet insert can have a rectangular opening disposed within the circular outlet. The bin outlet insert can be constructed to convey material in the cylindrical bin through the rectangular opening, thereby converting the circular outlet of the hopper bottom to a rectangular opening.

In fourth embodiments or any other embodiments, the bin outlet insert can have a top portion forming a tapered internal surface extending from a circular top perimeter. An external surface of the top portion can contact an internal wall of the hopper bottom and can support the bin outlet insert within the hopper bottom.

In fifth embodiments, a bin assembly can include a cylindrical bin, a tapered hopper bottom, a slide gate, and a bin outlet insert. The tapered hopper bottom can be arranged at a first end of the cylindrical bottom. The hopper bottom can have a circular outlet. The slide gate can be coupled to the circular outlet. The slide gate can be constructed to modulate material exiting the hopper bottom outlet by displacing to expose portions of the outlet. The bin outlet insert can be according to any of the first through fourth embodiments, or as described elsewhere herein.

In sixth embodiments, a system for proportioning material contained in bin assemblies can include at least one bin assembly according to any of the fourth through fifth embodiments, or as described elsewhere herein. The system can further include at least one conveyance constructed to receive material discharged from the at least one bin assembly.

In sixth embodiments or any other embodiments, the at least one conveyance can be a common conveyor belt disposed beneath each hopper bottom outlet.

In seventh embodiments, a system for proportioning material can include at least one bin assembly with a bin outlet insert according to any of first through third embodiments installed therein.

In eighth embodiments, a method for proportioning material contained in a plurality of bin assemblies having circular outlets can include, into an interior volume of a tapered hopper bottom of each bin, inserting a bin outlet insert with a rectangular opening such that the hopper bottom outlet is converted from a circular to rectangular outlet. The method can further include displacing a slide gate of each bin assembly with respect to the respective hopper bottom outlet to allow material contained therein to be discharged, the slide gate displacement having a linear correspondence to the amount of material discharged through the respective hopper bottom outlet. The method can also include combining the discharged materials together.

In eighth embodiments or any other embodiments, the combining can include discharging the materials onto a common conveyor system.

In eighth embodiments or any other embodiments, the materials can be different types of seeds and the combined materials can form a seed mix.

In ninth embodiments, a method can comprise dispensing material via a bin outlet insert according to any of first through third embodiments, wherein the insert is installed at a bottom of a bin containing the material to be dispensed.

In tenth embodiments, a bin insert can be used to perform the method of any of the eighth through ninth embodiments.

In eleventh embodiments, a bin insert can include any combination of features of the first through third and tenth embodiments.

In twelfth embodiments, a bin insert according to any of the above embodiments can be used to dispense a material contained by a bin.

Features of the disclosed embodiments may be combined, rearranged, omitted, etc., within the scope of the invention to produce additional embodiments. Furthermore, certain features may sometimes be used to advantage without a corresponding use of other features.

It is thus apparent that there is provided in accordance with the present disclosure, bin outlet inserts, and bin assembly systems and methods employing such inserts. Many alternatives, modifications, and variations are enabled by the present disclosure. While specific embodiments have been shown and described in detail to illustrate the application of the principles of the present invention, it will be understood that the invention may be embodied otherwise without departing from such principles. Accordingly, Applicants intend to embrace all such alternatives, modifications, equivalents, and variations that are within the spirit and scope of the present invention.

The invention claimed is:

1. A bin system comprising:

a cylindrical bin;

a tapered hopper bottom arranged at a first end of the cylindrical bottom, the hopper bottom having a circular outlet;

a slide gate coupled to the circular outlet and constructed to modulate material exiting the hopper bottom outlet by displacing to expose portions of the outlet; and a bin outlet insert disposed within the tapered hopper bottom adjacent to the circular outlet, the bin outlet insert having a rectangular opening disposed within the circular outlet, wherein the bin outlet insert is constructed to convey material in the cylindrical bin through the rectangular opening, thereby converting the circular outlet of the hopper bottom to a rectangular opening.

2. The bin system of claim 1, wherein the bin outlet insert has a top portion forming a tapered internal surface extending from a circular top perimeter, an external surface of the top portion contacting an internal wall of the hopper bottom and supporting the bin outlet insert within the hopper bottom.

3. The bin system of claim 1, further comprising at least one conveyance constructed to receive material discharged from the hopper bottom.

4. The bin system of claim 3, wherein the at least one conveyance is a conveyor belt disposed beneath the hopper bottom outlet.

* * * * *